US006707924B1

(12) United States Patent
Okiebisu

(10) Patent No.: US 6,707,924 B1
(45) Date of Patent: Mar. 16, 2004

(54) HOLDER FOR PORTABLE ELECTRONIC EQUIPMENT

(75) Inventor: Kazuaki Okiebisu, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/204,294

(22) Filed: Dec. 3, 1998

(30) Foreign Application Priority Data

Dec. 8, 1997 (JP) ..... P09-337530

(51) Int. Cl.[7] ..... H04R 25/00

(52) U.S. Cl. ..... 381/385; 381/374; 381/384; 381/395; 381/376; 379/430; 181/128; 181/129

(58) Field of Search ..... 381/385, 374, 381/376, 384, 388, 395; 181/128, 129; 455/90, 100, 569.1, 575.6; 24/9, 3.4, 3.7, 3.13, 17 B, 271, 282, 21, 11 R, 303; 379/430

(56) References Cited

U.S. PATENT DOCUMENTS 1,304,718 A * 5/1919 Townsend
1,554,119 A * 9/1925 Morgan
1,983,928 A * 1/1934 Brown
RE19,609 E * 6/1935 Albert
2,676,738 A * 4/1954 Herrick
4,070,553 A * 1/1978 Hass
4,347,956 A * 9/1982 Berger
4,485,276 A * 11/1984 Sato
4,901,405 A * 2/1990 Grover et al.
5,212,734 A * 5/1993 Tsao
5,222,279 A * 6/1993 Frano
5,701,356 A * 12/1997 Stanford

* cited by examiner

*Primary Examiner*—Curtis Kuntz
*Assistant Examiner*—Dionne Harvey
(74) *Attorney, Agent, or Firm*—Jay H. Maioli

(57) ABSTRACT

A holder to carry portable electronic equipment on the body of a user, include a cord loop adapted for carrying on the body of a user; the cord loop having a support to hold the electronic equipment and a connector adapted to normally maintain the cord loop and disconnect the cord loop the moment it is applied with a larger pulling force than a predetermined force.

3 Claims, 8 Drawing Sheets

HOLDER FOR PORTABLE ELECTRONIC EQUIPMENT

BACKGROUND OF THE INVENTION

1. Field of the Invention

The present invention relates to portable electronic equipment such as a radio receiver set, tape recorder, disc player, radiophone or the like, and more particularly to a holder for such portable electronic equipment, designed for use around the neck of a user to use the electronic equipment while being carried on him or her.

2. Description of Related Art

Electronic equipment such as a radio receiver, tape recorder, disc player or the like have been designed dramatically compact for easier portability.

Usually, such portable electronic equipment is carried in a clothing's pocket, a bag or by holding in hand.

It has been demanded to provide an electronic equipment of this type which a user can carry and use even while the user is moving, for example, while he or she is jogging.

To meet the above demand, portable electronic equipment has been proposed which is adapted to be carried stably on a user, for example, by hanging on the neck or the like, not holding in hand, and thus used even during his movement including walking, jogging or the like.

The conventional electronic equipment adapted for use by hanging on the neck or the like of a user is provided with a carrying cord loop, for example, which is to be put around the neck. However, such conventional electronic equipment is disadvantageous in that if the cord loop is accidentally caught and pulled by any obstructive thing, a pulling force will be applied directly to the neck portion, possibly causing a danger to the user. For example, while the user is jogging along an avenue or a street lined with trees or the like, the cord loop may possibly be caught by a low hanging branch of a tree or when the user is going to ride on or off a train or electric car, the electronic equipment at the end of the cord loop may possibly be caught between the closing doors. In any case, a pulling force will be applied directly to the user's neck, possibly causing a fatal danger to him. Although it seems to be an extreme case, it cannot be said to be impossible.

SUMMARY OF THE INVENTION

Accordingly, the present invention has an object to overcome the above-mentioned drawbacks of the prior art by providing a holder for a portable electronic equipment, adapted for safe carry and use on a user.

The present invention has another object to provide a portable electronic equipment holder adapted for carrying by hanging on the neck or any other part of a user's body as well as for immediate removal from on the user's body when a greater pulling force than predetermined is applied to the holder, to assure the safety of the user.

The present invention has still another object to provide a portable electronic equipment holder adapted to assure a user's comfort when wearing it around the neck.

The above object can be achieved by providing a holder for a portable electronic equipment such as radio receiver, tape recorder, disc player or the like, comprising a necklace-like loop of cords so extended out from the portable electronic equipment as to be put around the neck of a user and which can easily be disconnected and removed from around the neck when applied with a greater pulling force than predetermined.

According to the present invention, electric cords including a power line and/or signal line, etc. are incorporated in the cord loop, which contributes to a simple appearance of the cord loop.

According to the present invention, an earphone connector is provided as one component of the necklace-like cord loop in a cord connector to locate near the head or ear of a user a leading portion of a connecting cord of a headphone placed on the head or an earphone put into the auricle, which contributes to a reduced length of the earphone cord.

BRIEF DESCRIPTION OF THE DRAWINGS

These objects and other objects, features and advantages of the present intention will become more apparent from the following detailed description of the present invention applied to a portable radio receiver and portable telephone when taken in conjunction with the accompanying drawings, of which.

DETAILED DESCRIPTION OF THE PREFERRED EMBODIMENTS

The first embodiment of the present invention will be described hereinunder with reference to FIGS. 1 to 12.

Figure 1:
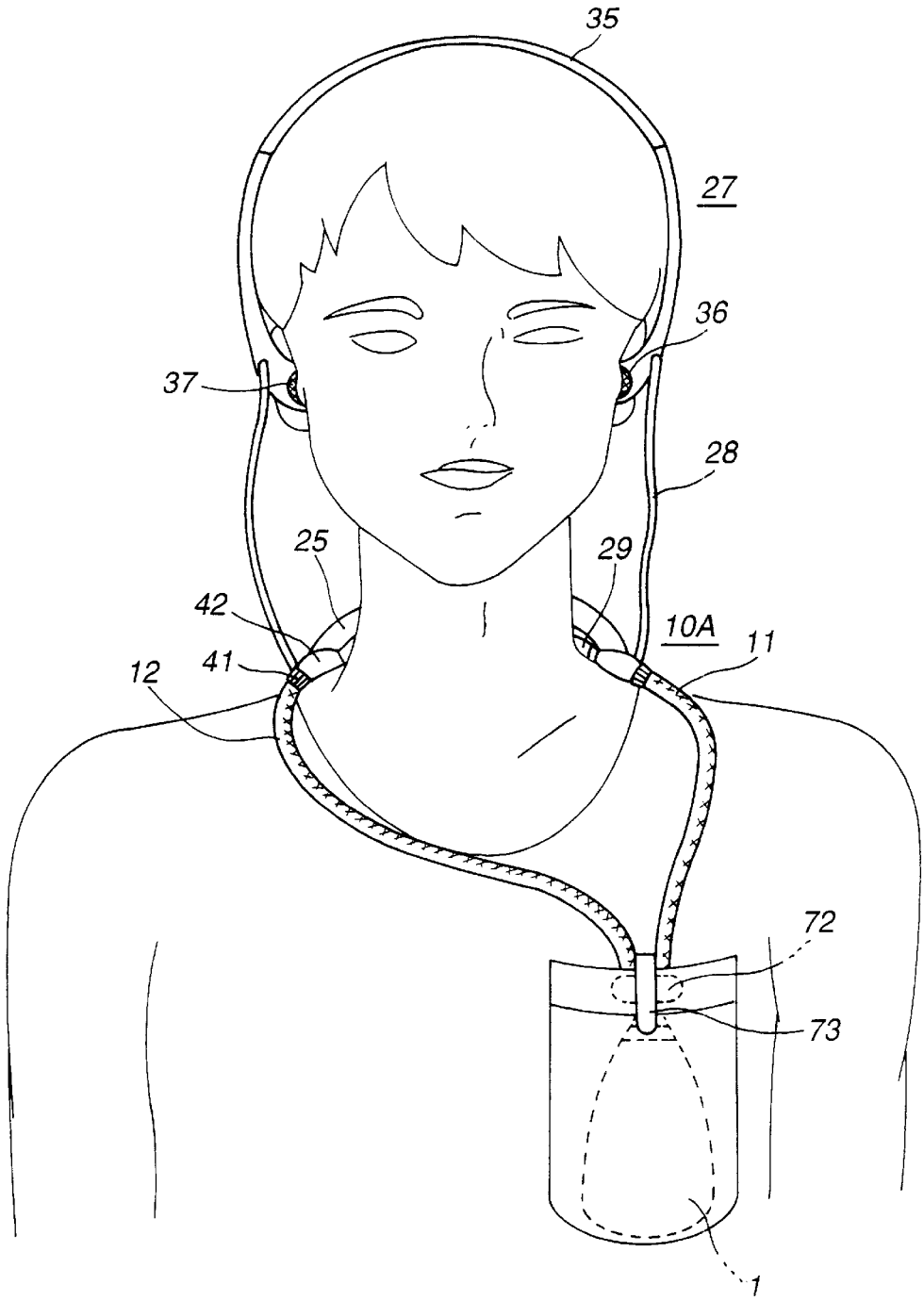
FIG. 1 is a perspective view of a first embodiment of the holder for a portable electronic equipment (radio receiver in this embodiment) according to the present invention, put on the body of a user.
Figure 2:
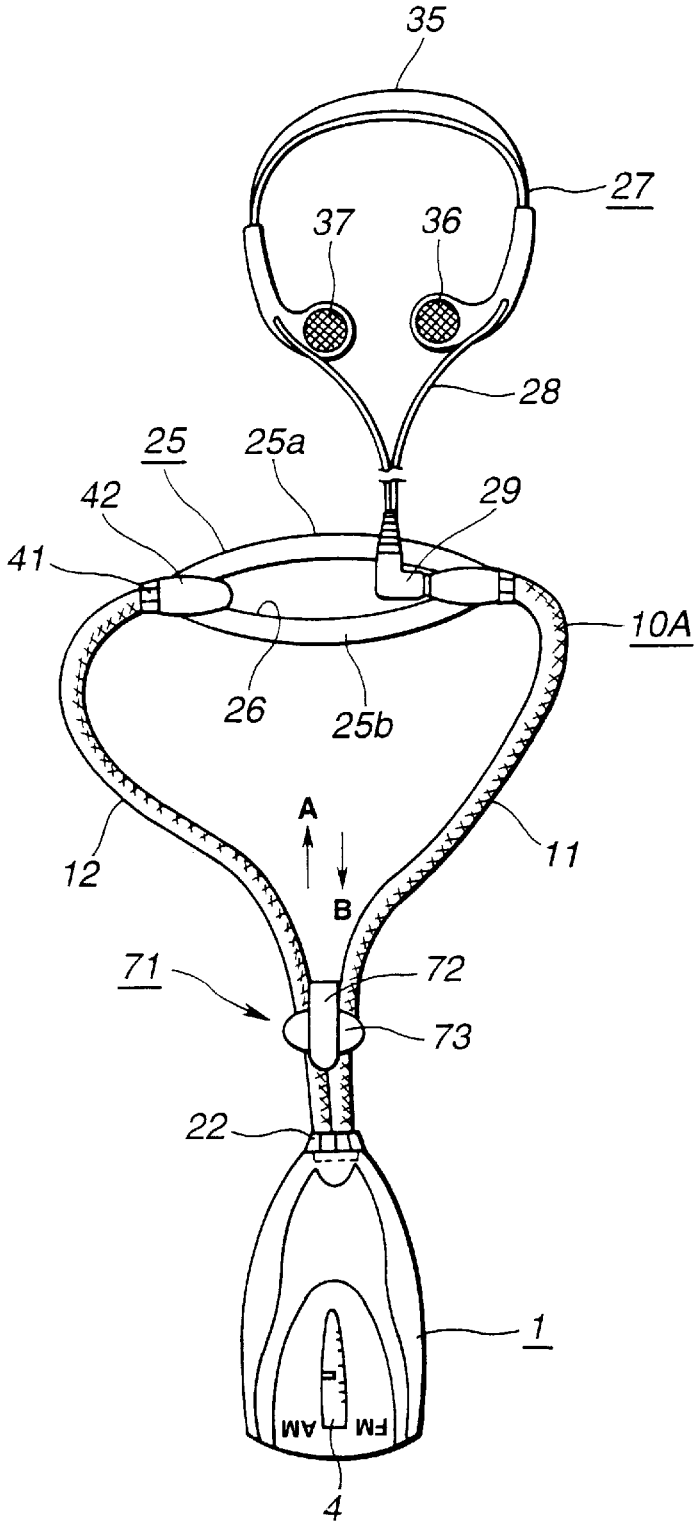
FIG. 2 is a perspective view of the portable radio receiver holder of the present invention in FIG. 1, not put on the user's body.
Figure 3:
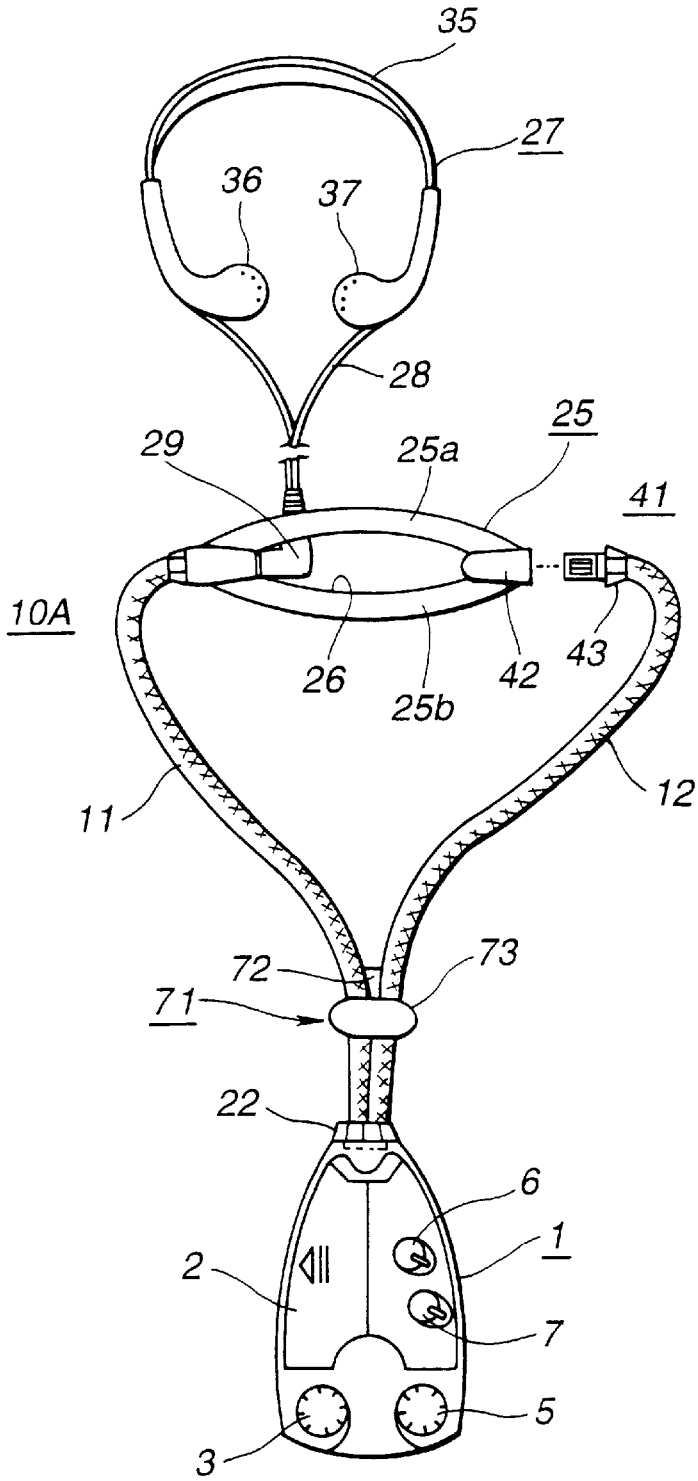
FIG. 3 is a perspective rear view of the portable radio receiver holder according to the present invention in FIG. 2, one of the necklace-like loop of cords included in the holder being disconnected from the other that is a connector in the cord loop.

Referring now to FIGS. 1 to 3, the portable electronic equipment is a portable radio receiver unit generally indicated with a reference 1 and designed to receive AM and FM broadcasts. The radio receiver unit 1 incorporates a radio receiver circuit having an AM antenna to receive AM broadcasts, and has a compartment which houses a cell or cells as a power source to drive at least the radio receiver circuit and an earphone through which a received radio broadcast is heard.

The radio receiver unit 1 has provided on the front side of the casing thereof a dial indicator 4 to read a received frequency. The radio receiver unit 1 has also provided on the rear side of the casing thereof a battery compartment lid 2 for access to the battery compartment, a received frequency tuning dial 3, a sound volume control 5, an AM/FM band selector 6, and a power on-off switch 7.

Figure 5:
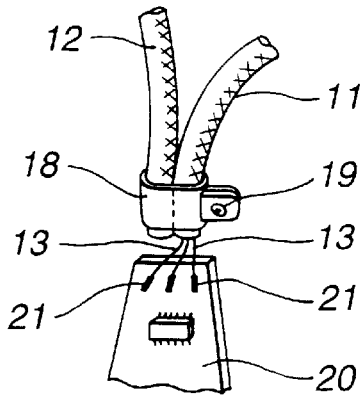
FIG. 5 is a perspective view of the connection of one of the cords included in the necklace-like cord loop to a printed wiring board disposed in the portable radio receiver.

The radio receiver unit 1 is designed at one side portion thereof to retain two cords 11 and 12. Inside the radio receiver unit 1, the cords 11 and 12 are fixed together at one pair of ends thereof with a retainer 18 as shown in FIG. 5. The cords 11 and 12 are led from the radio receiver unit 1 through a hole formed at the one side portion of the radio receiver unit 1. The other ends of the cords 11 and 12 thus led out are connected to each other by female and male connectors 25 and 41, respectively. The pair of one cord 11 and female connector 25 and pair of the other cord 12 and male connector 41 form together a necklace-like cord loop generally indicated with a reference 10A. The necklace-shape cord loop 10A is used as shown in FIG. 1. Namely, the user puts the cord loop 10A around the neck (actually the boundary between the neck and shoulder) from above the head and thus holds the radio receiver unit 1 on his body or in a pocket of his clothing as shown in FIG. 1.

The cords 11 and 12 are made of materials sufficiently flexible for the cords 11 and 12 to easily fit the user's body shape when the cord loop is put around the neck.

Figure 4:
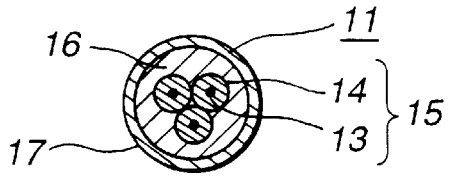
FIG. 4 is a sectional view of the cord of the cord loop of the portable radio receiver holder according to the present invention.

As shown in FIG. 4, the cord 11 comprises three wires 15 as a core, each consisting of a conductor 13 made of copper or the like and a synthetic resin sheath 14 formed on the conductor 13, a cloth sheath 16 over the three wires 15, and a water-repellent sheath 17 formed on the cloth sheath 16. One of the three conductors 13 in the cord 11 is used as a power line for supplying the earphone with a power from a power source (battery or batteries) incorporated in the radio receiver unit 1, another one is used as a signal line for supplying the earphone with a signal received by the radio receiver unit 1, and the remaining one is used as an antenna (also as grounding conductor) for receiving FM broadcasts.

The cord 12 consists of a plurality of synthetic resin wires, a cloth sheath formed on the wires, and a water-repellent sheath formed on the cloth sheath.

As previously mentioned with reference to FIG. 5, the cords 11 and 12 are fixed together at one pair of ends thereof with the retainer 18 inside the radio receiver unit 1. The retainer 18 is a metal sheet bent to a generally U shape so that its opposite ends overlap each other. A screw hole is formed through the opposite overlapping ends of the retainer 18. A fixing screw 19 is provided through the screw hole and tightened to secure the ends of the cords 11 and 12 together in the retainer 18.

Each of the conductors 13 of the wires 15 in the cord 11 is led out of the cord 11 and connected electrically and mechanically, by soldering, to a set of corresponding connecting terminals 21 provided on a printed wiring board 20 disposed inside the radio receiver unit 1. The printed wiring board 20 is adapted to mount thereon electronic devices and the like forming the radio receiver circuit and power circuit.

A support sleeve 22 is provided and fixed to an open end of the through-hole formed at one end portion of the radio receiver unit 1. The cords 11 and 12 are led out through the hole and also the support sleeve 22. The sleeve 22 thus assures a more positive holding of the radio receiver unit 1 by the cords 11 and 12.

Figure 6:
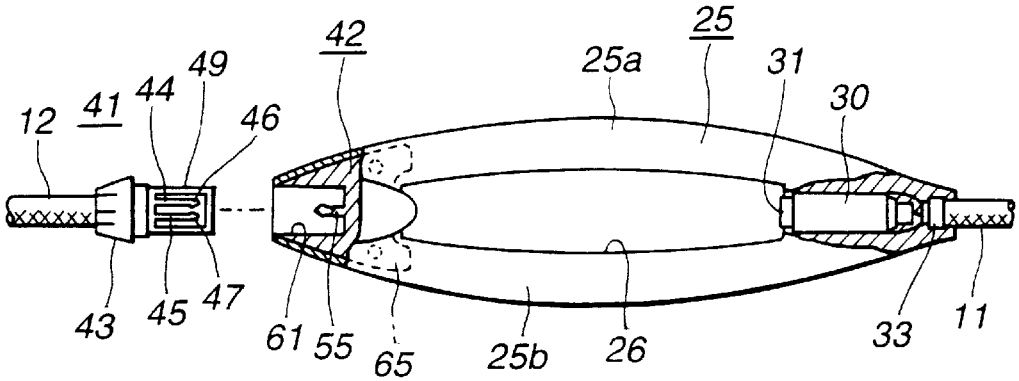
FIG. 6 is a partially sectional view of the female connector included in the cord loop to provide a connection between the cords.

The female connector 25 is made of a flexible material such as soft polyvinyl chloride, elastomer or the like so that it will easily be deformed along the profile of the user's neck when the cord loop is put around the neck. As shown in FIG. 6, the female connector 25 comprises a pair of arcuate segments 25*a* and 25*b* which form together an elliptic ring. Thus the arcuate segments 25*a* and 25*b* define an elliptic central opening 26 between them when the connector 25 is molded.

Figure 7:
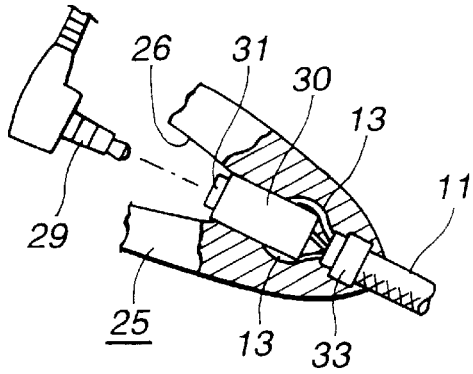
FIG. 7 is a partially sectional, fragmentary perspective view of the female connector, showing the earphone cord plug going to be connected to the earphone jack provided in the female connector.

An earphone (or headphone) 27 is used with the radio receiver to listen to a radio broadcast received by the radio receiver. An earphone cord 28 led from the earphone 27 has an earphone plug 29 connected to an end opposite end thereof to an to which the earphone 27 is connected. The earphone plug 29 is removably connected to an earphone jack 30 provided in one end portion of the female connector 25 at the junction of the arcuate segments 25*a* and 25*b*. The female connector 25 has formed in the end portion thereof a hole 31 open at the central opening 26 and in which the earphone plug 29 is to be inserted. As shown in FIGS. 6 and 7, the female connector 25 has also provided in the opposite side of the end portion thereof a bush ring 33 through which the other end of the cord 11 is led into the female connector 25. Namely, for disposing in a mold for the female connector 25 the earphone jack 30 and the bush ring 33 with the ends of the cord 11 passed through it, they are inserted in place in the mold and then molded by injection of the material of the female connector 25 (inserted molding). The three conductors 13 of the cord 11 are connected to corresponding connection pieces of the earphone jack 30.

The earphone jack 30 is fixed in the female connector 25 for its hole 31 to be open at the central opening 26. When the plug 29 of the earphone 27 is inserted into the earphone jack 30, it will be positioned inside the central opening 26 defined by the pair of the arcuate segments 25*a* and 25*b*, as will been seen from FIG. 2. Therefore, the earphone plug 29 will seldom be caught by, or get into contact with, any other thing, so that it can be securely kept connected to the earphone jack 30.

As shown in FIGS. 1 to 3, the earphone 27 connected to the earphone jack 30 via the earphone plug 29 is a headphone with a pair of speaker units 36 and 37, right and left, provided at opposite ends of a head band 35 which is to be placed on the user's head.

When the earphone plug 29 is connected to the earphone jack 30 with the radio receiver unit 1 set to receive an FM broadcast, the earphone cord 28 to which the plug 29 of the earphone 27 is connected will work with the wires 15 in the cord 11 as FM antennae for receiving FM broadcasts.

As seen from FIGS. 3 to 6, the female connector 25 has provided, in the opposite end portion thereof to the end portion in which the earphone jack 30 is provided, a coupler 42 to which the male connector 41 connected to the other end of the cord 12 is removably connectable.

Figure 8:
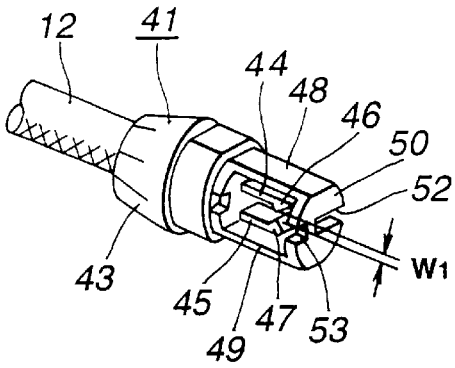
FIG. 8 is a perspective view of the other cord for connection to the male connector.

As shown in FIGS. 6 and 8, the male connector 41 has a base portion 43 in which the other end of the cord 12 is secured. The base portion 43 is molded from a synthetic resin to have a pair of catching projections 44 and 45 formed integrally therewith and whose respective ends are formed as engagement pawls 46 and 47, respectively. The base portion 43 is further formed to have outer projections 48 and 49 extending outside and along the catching projections 44 and 45, respectively, and a bridging end wall 50 connecting the ends of the outer projections 48 and 49. The outer projections 48 and 49 are provided to protect the catching projections 44 and 45 by restraining the catching projections 44 and 45 from being excessively deflected when elastically deflected away from each other. The bridging end wall 50 of the male connector 41 has formed therein a slit 52 in which a retainable or to-be-retained plate-like projection 55 formed inside the coupler 42 is to be introduced and caught between the pair of catching projections 44 and 45, and a guide recess 53 in which an inserting-direction control projection 56 formed also inside the coupler 42 is to be engaged. Thus, when the male connector 41 is plugged into the coupler 42 of the female connector 25, it is guided by the projections 55 and 56 of the coupler 42 engaged in its slit 52 and guide recess 53, respectively. That is to say, the male connector 41 is correctly aligned and positively connected to the coupler 42, namely, to the female connector 25 because such projections, slit and recess work together to limit the male connector 41 from taking a wrong angular position in relation to the coupler 42.

Figure 9:
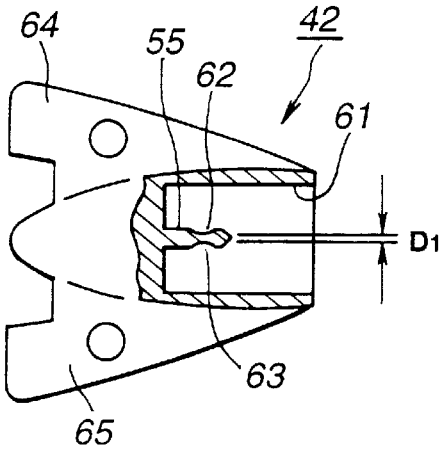
FIG. 9 is a sectional view of the coupler incorporated in the female connector.
Figure 10:
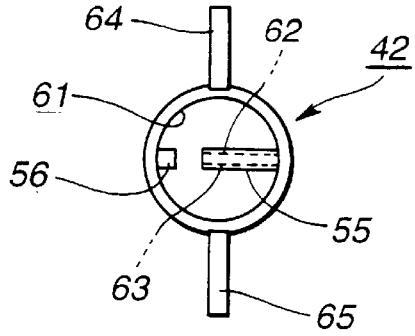
FIG. 10 is a front view of the coupler in FIG. 9.

As seen from FIG. 9, the coupler 42 into which the male connector 41 is to be fitted has a socket 61 formed therein. The above-mentioned retainable projection 55 is formed on the inner side and innermost walls of the socket 61, extending toward the opening of the socket 61 as shown in FIG. 10. As mentioned above, the plate-like projection 55 is to be caught between the pair of catching projections 44 and 45 of the male connector 41. It has formed on the opposite sides thereof and at an intermediate position thereon recesses 62 and 63 in which the pawls formed at the respective ends of the pair of catching projections 44 and 45 are to engage. The remaining thickness $D_1$ of the projection 55 between the engagement recesses 62 and 63 is slightly larger than a spacing $W_1$ between the pair of pawls 46 and 47. Since the retainable plate-like projection 55 is thus formed, the pair of pawls 46 and 47 will securely be pressed in the recesses 62 and 63 under the effect of elastic deflection of the pair of catching projections 44 and 45 when the male connector 41 is plugged into the coupler 42, namely, when it is connected to the female connector 25.

For easy fixation of the coupler 42 in the female connector 25, a pair of fin-shaped fixture pieces 64 and 65 is formed around the socket 61.

To mold the coupler 42 in the female connector 25, it is inserted in place in the mold for the female connector 25 for the socket 61 in the coupler 42 to be open out at the opposite end of the female connector 25 to the end where the earphone jack 30 is from be molded. Thus the coupler 42 is molded integrally in the female connector 25 as shown in FIG. 6.

When the male connector 41 integrally fixed to the free end of the cord 12 is plugged into the coupler 42 provided in the female connector 25, the cords 11 and 12 form together a necklace-like cord loop 10A as shown in FIGS. 1 and 2.

For connecting the cord 12 to the female connector 25, the male connector 41 at the end of the cord 12 is plugged into the socket 61 of the coupler 42. For this connection, the male connector 41 is positioned so that the plate-like projection 55 and inserting-direction control projection 56 of the coupler 42 are engaged in the slit 52 and guide recess 53, respectively, and then fitted into the socket 61 of the coupler 42. As the male connector 41 is further inserted into the coupler 42 after the projections 55 and 56 are engaged in the slit 52 and recess 53, respectively, the male connector 41 is inserted while the pair of catching projections 44 and 55 is being elastically deflected away from each other by the projection 55, until the end face of the base portion 43 of the male connector 41 abuts the open end of the socket 61 of the coupler. Then, the pair of pawls 46 and 47 is engaged in the engagement recesses 62 and 63, respectively under the effect of elastic deflection of the pair of catching projections 44 and 45. Thus the male connector 41 is engaged in the coupler 42 with a predetermined force of retention.

By plugging the male connector 41 into the coupler 42 of the female connector 25 as in the above, the cords 11 and 12 are coupled to each other to form a cord loop. When any of the cords 11 and 12 is pulled with a large force, the male connector 41 will be disengaged from the coupler 42 of the connector 25 and thus the cords 11 and 12 be uncoupled from each other. Therefore, even if any of the cords 11 and 12 and radio receiver unit 1 is applied with such a large pulling force while the cord loop 10A is being used around the user's neck, the male connector 41 is released from the coupler 42 and the cords 11 and 12 are uncoupled from each other. It is possible to avoid a danger that the user's neck will be fastened by the cord loop 10A. Hence, the holder can be used very safely.

As mentioned above, the male connector 41 is engaged in the coupler 42 with the predetermined force of retention owing to the retention of the projection 55 by the pair of catching projections 44 and 45. Therefore, when the male connector 41 is disengaged from the coupler 42 due to a large pulling force applied to the cord loop (cord 11 or 12) or radio receiver unit 1, the pawls 46 and 47 are disengaged from the recesses 62 and 63 while the pair of catching projections 44 and 45 is elastically deflected away from each other. Therefore, the male connector 41 and coupler 42 may not possibly be damaged. For forming the cord loop again, the male connector 41 is plugged into the coupler 42 of the female connector 25 to thus couple the cords 11 and 12.

Figure 11:
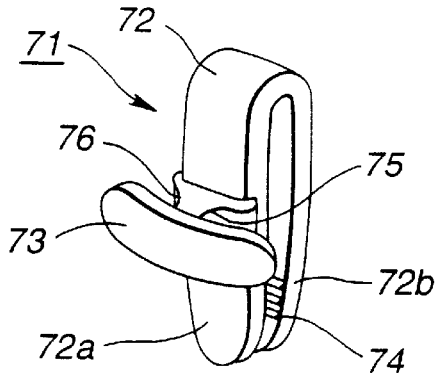
FIG. 11 is a perspective view of the cord clip to which the two cords are fitted.
Figure 12:
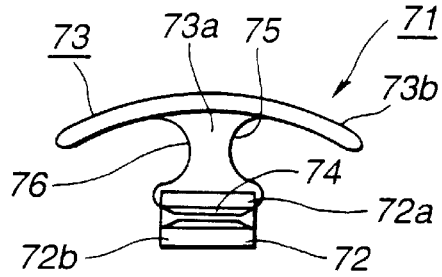
FIG. 12 is a front view of the cord clip.

Furthermore, a clip 71 as shown in FIGS. 1 and 2 is provided to retain the cords 11 and 12 extending from the radio receiver unit 1. The clip 71 is used to attach the flexible cords 11 and 12 to a part of the user's clothing or the like, thereby permitting the user to stably hold the radio receiver unit 1 on the user's body. The clip 71 is made of an elastically deformable synthetic resin. It includes a base 72 formed to have a generally U shape and a cord retainer 73 as shown in FIGS. 11 and 12. The base 72 of the clip 71 thus includes a pair of arms 72*a* and 72*b* forming together the generally U shape. Projections 74 are formed on the inner surface of each of the arms 72*a* and 72*b* and at the end portions thereof. The projections 74 on both the arms 72*a* and 72*b* cooperate together to prevent the clip 71 from easily slipping off a part of the user's clothing where the clip 71 is attached.

As shown in FIG. 12, the cord retainer 73 is provided outside one (72*a*) of the arms 72*a* and 72*b* of the clip base 72. It includes a piece 73*a* rising from the outer surface of the arm 72*a*, and a cord retaining piece 73*b* formed at the top of the rising piece 73*a* and extending orthogonally to the extending direction of the base 72. The cord retaining piece 73*b* is curved toward the rising piece 73*a* as shown. The rising piece 73*a* is concaved semi-circularly on either side face thereof (at 75 and 76) to retain the cord. The radius of these semi-circular concavities 75 and 76 is slightly smaller than that of the cords 11 and 12 for the purpose of securely retaining the cords 11 and 12.

The clip 71 thus constructed is used as follows. The cords 11 and 12 are fitted at the intermediate portions thereof into the semi-circular concavities 75 and 76. As shown in FIG. 1, the clip 71 is attached to a part of the user's clothing, for example, a pocket, by pinching it between the arms 72*a* and 72*b* of the clip base 72. Thus the cords 11 and 12 can be fixed to the user's clothing, thereby permitting the user to stably hold on the user's body the radio receiver unit 1 supported at the end of the cords 11 and 12.

Since the cords 11 and 12 are fitted in the semi-circular concavities 75 and 76, the clip 71 may be easily slid along the cords 11 and 12 in the direction of arrow A or B to a desired position as shown in FIG. 2. Therefore, the cords 11 and 12 can be fixed at a desired position on the user's clothing by sliding the clip 71 along the cords 11 and 12.

As having been described in the foregoing, the holder for portable radio receiver unit according to the present invention comprises the cords 11 and 12 which can be connected to each other to form the necklace-like cord loop 10A by plugging the male connector 41, fixed to the end of the cord 12 led from the radio receiver unit 1, into the coupler 42 provided in the female connector 25 connected integrally to the end of the cord 11 led from the radio receiver unit 1. The necklace-like cord loop 10A is used around the neck of a user. Since the clip 71 retains the cords 11 and 12 to a part of the user's clothing as mentioned above, the cords 11 and 12 and the radio receiver unit 1 can be attached on the user's body. Namely, the user can hold the radio receiver unit 1 stably on his body.

When the necklace-like cord loop 10A put around the neck of a user is pulled with a large force, for example, when the cord 11 or 12 or the radio receiver unit 1 is caught and pulled by any obstructive thing, the male connector 41 will be disengaged from the coupler 42 of the female connector 25 and thus the cords 11 and 12 will be uncoupled from each other. Thus, the large pulling force will not be exerted on the user's neck. Namely, the holder can be used around the user's neck very safely.

In the first embodiment having been described in the foregoing, the earphone is a headphone type having a head band. However, the present invention may of course use a so-called inner type earphone whose speaker unit is inserted directly into the auricle.

Also, the present invention may be applied to a portable tape recorder, disc player, portable telephone, transceiver or the like as well as to the radio receiver as having been described in the foregoing.

Here, a variant of the present invention applied to a portable telephone will be described herebelow with reference to FIG. 13.

Figure 13:
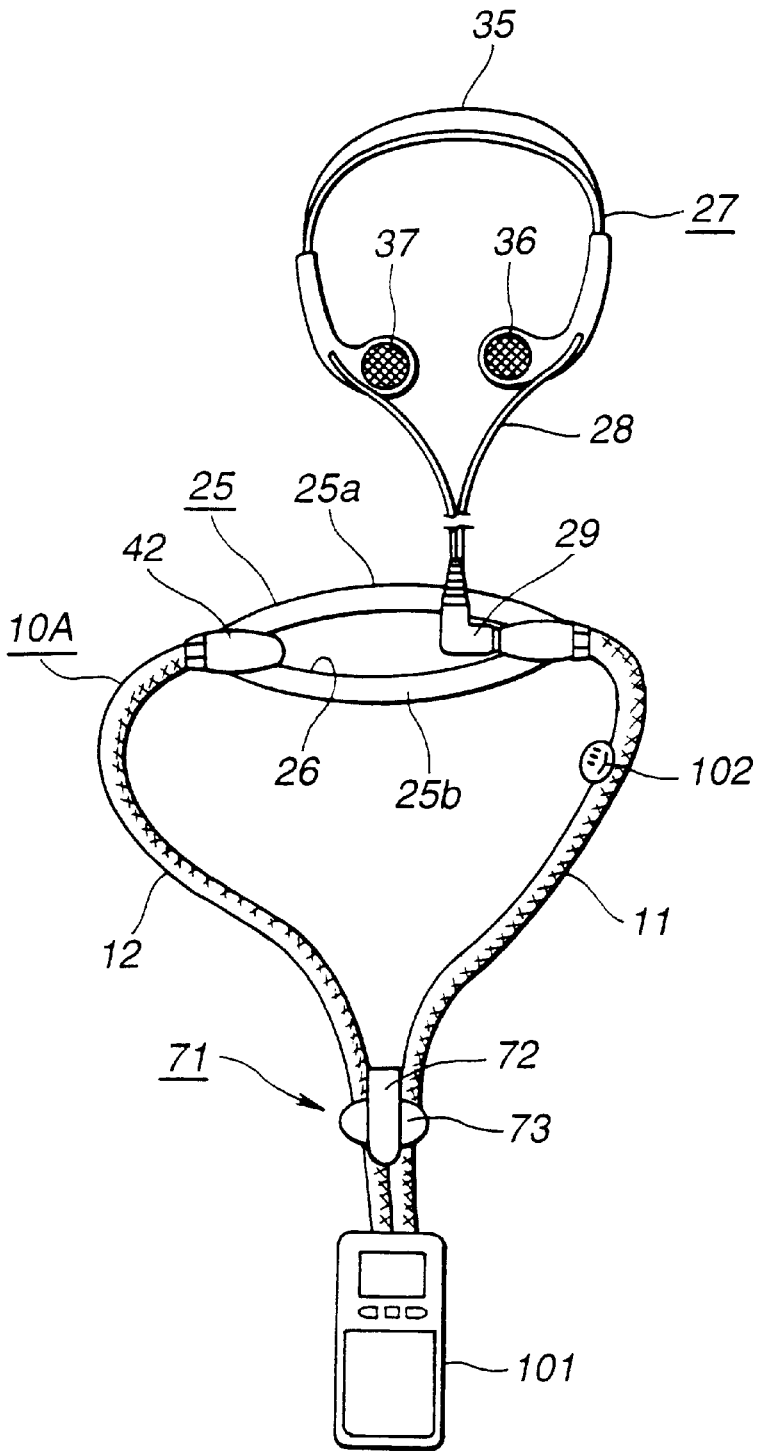
FIG. 13 is a perspective view of a portable telephone to which the present invention is applied.

In FIG. 13, the same or similar parts as in FIGS. 1 to 12 are indicated with same or similar reference numerals and will not be described any more.

Referring to FIG. 13, the portable telephone to which the present invention is applied is generally illustrated with a reference 101. It incorporates a handset necessary to construct the portable telephone unit 101. A microphone 102 being a speech transmitter is provided in the middle of the cord 11. It is connected to the wire 15 including the conductors 13 forming together the cord 11. The earphone 27 connected by the connecting plug 29 to the earphone jack 30 provided in the connector 25 is used as a speech receiver. Note that the conductors led from the telephone unit 101 to the microphone 102 must include power and signal lines for the microphone and thus must be more than 3 in number.

The holder used with such a telephone set can also be safely used on the user's body as having been aforementioned.

The aforementioned embodiments of the present invention use the necklace-like cord loop 10A.

Figure 14:
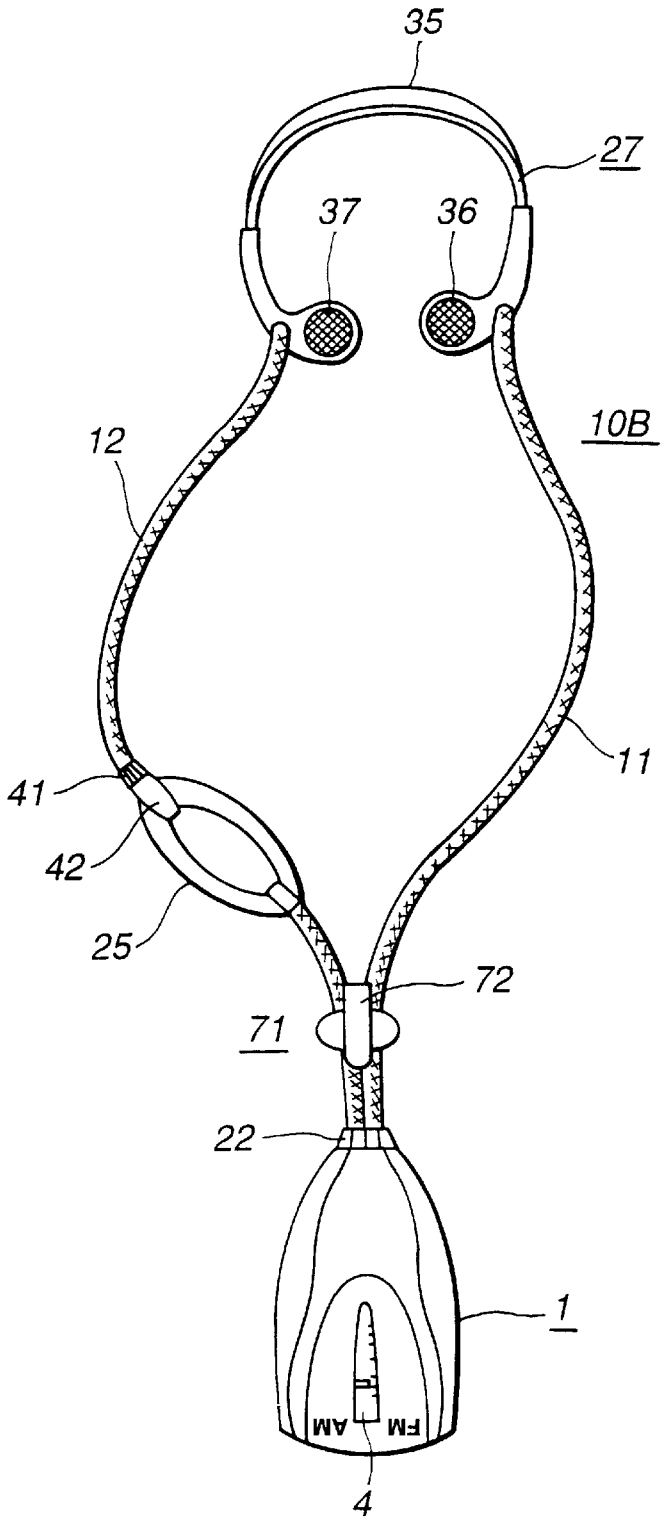
FIG. 14 is a second embodiment of the portable radio receiver holder according to the present invention, not put on the user's body.

Furthermore, the second embodiment of the present invention will be described hereinunder with reference to FIG. 14. Note that FIG. 14 corresponds to FIG. 2. Same or similar parts as in FIG. 12 will be indicated with same or similar reference numerals and will not be described any more. In this embodiment, the earphone 27, and cords 11 and 12 are connected to form a cord loop 10B. The user uses on this body this holder with the earphone 27 set on his head. Both the connectors 25 and 41 forming together the loop connector are provided in the cord 12 connected between the radio receiver unit 1 and earphone 27. The cord 11 connected between the radio receiver unit 1 and earphone 27 has a plurality of conductors 13 including power and signal lines, etc. The conductors 13 are led through the speaker unit 36 and head band 35 and connected to the speaker unit 37. When the earphone 27 is set on the user's head and the radio receiver unit 1 is put in a pocket, for example, of the user's clothing, the connectors 25 and 41 will be positioned on the user's chest. The second embodiment also shows the same effect as the first embodiment.

As having been described in the foregoing, the cords of the portable electronic equipment holder according to the present invention are coupled to each other to form a cord loop. Since the portable electronic equipment can thus be carried on a user with the cord loop placed on his body, the user can use the electronic equipment while he is moving his body, such as during walking, jogging or the like, without holding the electronic equipment in hand.

If a large pulling force is applied to any of the cords or the electronic equipment to which the cords are connected while the electronic equipment is being used on the user's body, the cord loop is disconnected and automatically removed from the user's body, so that no large shock will be applied to the user. Hence, the holder can thus be used very safely.

Since the cord led from the electronic equipment incorporates the conductors including the power and signal lines, the number of exposed wires led from the electronic equipment can be reduced and thus the electronic equipment carried on the user's body can be used while the user is less bothered with such exposed wires. The portable electronic equipment holder according to the present invention can assure a user's comfort when wearing it around the neck or any other body portion.

What is claimed is:

1. A portable audio apparatus comprising:

a portable audio device;

a tubular connecting device;

a first cord containing an electrical conductor and having a jack provided at one end portion thereof, said one end portion being connected to said connecting device, and an other end portion of said first cord being electrically connected to said portable audio device, a second cord not containing an electrical conductor and being connected at one end portion thereof to the other end portion of said first cord, an other end portion of said second cord being releasably connected to said connecting device, so that said second cord is released from said connecting device upon exceeding a predetermined tension force applied in a direction along a center axis of said tubular connecting device, wherein said apparatus further comprises a member provided on the other end portion of said second cord, and said connecting device includes a catching portion provided on an end portion thereof, said catching portion being elastically held by said member.

2. The portable audio apparatus according to claim 1, wherein said apparatus further comprises a clip moveable between the one end portions of said first and second cords and the other end portions of said first and second cords.

3. A portable audio apparatus a portable audio device;

a tubular connecting device;

a first cord containing an electrical conductor and having a jack provided at one end portion thereof, said one end portion being connected to said connecting device, and an other end portion of said first cord being electrically connected to said portable audio device, a second cord not containing an electrical conductor and being connected at one end portion thereof to the other end portion of said first cord, an other end portion of said second cord being releasably connected to said connecting device, so that said second cord is released from said connecting device upon exceeding a predetermined tension force applied in a direction along a center axis of said tubular connecting device, a member provided on said connecting device, wherein a catching portion is provided on the other end portion of said second cord, said catching portion being elastically held by said member.

* * * * *